United States Patent [19]

Pegg et al.

[11] 4,165,475

[45] Aug. 21, 1979

[54] DISCHARGE LAMP WITH STARTER CIRCUIT

[75] Inventors: John C. Pegg; Clive R. Walker, both of London, England

[73] Assignee: Thorn Electrical Industries Limited, London, England

[21] Appl. No.: 897,631

[22] Filed: Apr. 17, 1978

[30] Foreign Application Priority Data

Apr. 18, 1977 [GB] United Kingdom ..... 16044/77

[51] Int. Cl.[2] ..... H05B 41/18

[52] U.S. Cl. ..... 315/99; 315/100; 315/101; 315/106; 315/DIG. 5

[58] Field of Search ..... 315/99, 100, 101, 106

[56] References Cited

U.S. PATENT DOCUMENTS

| | | | |
|---|---|---|---|
| 3,588,592 | 6/1971 | Brandstadter | 315/99 |
| 3,649,869 | 3/1972 | Nomura et al. | 315/100 X |
| 3,836,817 | 9/1974 | Tchang et al. | 315/100 |

FOREIGN PATENT DOCUMENTS

| | | | |
|---|---|---|---|
| 1223733 | 3/1971 | United Kingdom | 315/99 |
| 1254894 | 11/1971 | United Kingdom . | |
| 1278839 | 6/1972 | United Kingdom | 315/99 |

*Primary Examiner*—Alfred E. Smith
*Assistant Examiner*—Charles F. Roberts
*Attorney, Agent, or Firm*—Robert F. O'Connell

[57] ABSTRACT

A starter circuit for a hot cathode discharge lamp which has a switching element which is connected across the lamp to permit a cathode heating current to flow and then opens to permit the lamp to strike. The starter circuit has a thyristor as the switch element, and a control circuit for rendering the thyristor conductive at a desired point during each cycle of the applied voltage. The control circuit includes means for increasing the instantaneous applied voltage which is required to trigger the thyristor with successive cycles of the applied voltage after switch-on of the circuit. This means preferably includes a capacitor which is progressively charged to provide an increasing bias which must be overcome by the applied voltage. If the lamp fails to strike, the required voltage for triggering goes on increasing until it is too high for the thyristor to trigger at all. No damage can then occur to the starter circuit or the lamp ballast.

21 Claims, 12 Drawing Figures

DISCHARGE LAMP WITH STARTER CIRCUIT

This invention relates to the starting of discharge lamps.

The most common method of starting discharge lamps is by the use of a glow switch starter. A description of this and other starter circuits is to be found in "Lamps and Lighting" by S. T. Henderson and A. M. Marsden, Second Edition, 1972, published by Edward Arnold, London.

This type of starter is simple, cheap and generally effective, but suffers from a number of disadvantages, in particular:

(a) It has mechanical contacts which give it a limited life.

(b) When the lamp fails the starter continues to try to start the lamp; this can not only cause the lamp to flicker annoyingly but puts great strain on the starter, which almost invariably has to be replaced along with the lamp. This problem can be overcome by adding a special thermal cut-out, but this increases expense.

(c) The starting time is long and rather variable.

(d) "Cold starting" effects may be evident near the end of the starter life, that is the arc may strike with insufficient pre-heating of the cathodes, leading to blackening of the tube walls adjacent the cathodes.

To overcome this problem the semi-resonant start circuit (see "Lamps and Lighting" supra) was developed as an alternative to the glow switch. This is more expensive and slightly less efficient than the glow switch starter. The fuse incorporated in the circuit must also be critically rated since a short circuit failure of the capacitor in the circuit would cause the ballast to overheat. It does however have the advantages of high reliability, a visually more acceptable start, and that it is no longer necessary to replace the starter with the lamp.

Previous proposals have been made to develop starter circuits which overcome some of the other disadvantages of the glow switch starter by using an electronic switch. One example of this is British Pat. No. 1,223,733 which employs a silicon controlled rectifier (SCR) as the switch, and has a triggering circuit for triggering the SCR into conduction once during each cycle of the supply voltage. The circuit operates by triggering the SCR at a point during the positive half cycle of the supply voltage waveform. Current then flows through the choke ballast, the lamp cathodes and the starter, thus heating the lamp cathodes. Due to the choke inductance, a point will arise during the subsequent negative half-cycle where the current reduces to zero, and at this point the SCR will turn non-conductive. This causes a negative inductive transient across the starter, and hence the lamp, which hopefully causes the lamp to strike. If it does not, the sequence of operations continues on subsequent cycles of the supply voltage until it does. When the lamp strikes, the voltage across the starter falls to a value which is low enough to prevent further triggering of the SCR.

The time between the previous zero-crossing of the supply voltage waveform and the instant when the SCR conducts may be termed the trigger angle. The setting of this trigger angle is critical. If the trigger angle, and hence the instantaneous supply voltage at the trigger point, is too low, then the starter may trigger when the lamp is running, and also if the lamp fails there will be a relatively high cathode current which could cause a high temperature rise in the ballast choke. Conversely, if the trigger angle is too high, the cathode heating current will be too low and the lamp may "cold start", or even fail to start, particularly if the supply voltage is at all reduced below the nominal value.

It is difficult to reconcile these conflicting requirements for the trigger angle, particularly in the commercial manufacture of the devices where individual components may have characteristics which vary over a tolerance range about the nominal characteristics.

This invention provides a starter circuit for a discharge lamp which reduces at least some of the foregoing disadvantages.

Our invention provides a discharge lamp starter circuit having two starter input terminals for connection to the cathodes of a discharge lamp for receiving a cyclically-varying voltage supplied through both the lamp cathodes and a reactive ballast, the starter circuit comprising a controlled switch connected across the starter input terminals, and a control circuit for rendering the switch conductive at a desired point during the cycle of the applied voltage, the control circuit including means tending to increase the instantaneous applied voltage which is required for such conduction to occur, with successive cycles of the applied voltage after switch-on of the circuit. The cyclically-varying voltage as applied to the starter circuit will commonly be a conventional sinusoidal alternating voltage but can be a rectified alternating voltage.

Preferably the controlled switch will be a semi-conductor device, an example of which is a thyristor (an SCR or a triac), which is triggered by the control circuit. The control or trigger circuit preferably incorporates a capacitor, the charge upon which progressively varies with successive cycles of the applied voltage to vary the trigger point at which conduction occurs. However, other ways of varying the trigger point may be used, thermal control being one example.

In a preferred starter circuit of this type the initial conduction or trigger voltage is relatively low, causing a relatively large cathode heating current to flow, while keeping the positive voltage across the lamp low to minimize "cold starting" effects. The trigger voltage then increases cycle-by-cycle, and the consequent increased positive voltage across the lamp assists the arc to strike. If the lamp fails to strike, the trigger voltage requirement goes on increasing until it is too high for triggering to occur at all. Current through the starter, and hence the lamp cathodes and the reactor (normally an inductor), then substantially ceases so that no damage can occur to the starter or the inductor. If the lamp does strike, the increased trigger voltage requirement ensures that retriggering cannot take place on the lamp voltage waveform, even at low ambient temperatures where relatively high peak lamp voltages occur. When the circuit is switched off it is reset ready for the next switch-on.

Various embodiments of the invention will now be described in more detail, by way of example, with reference to the drawings accompanying the Provisional Specification, in which.

Figure 1:
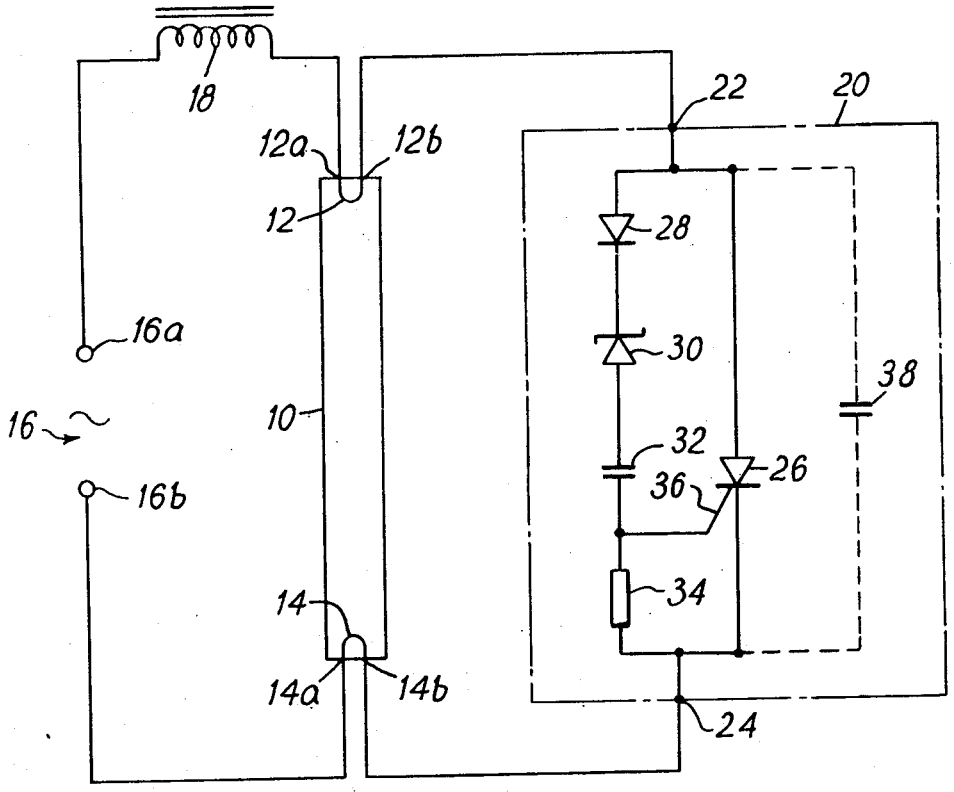
FIG. 1 is a circuit diagram of a first starter circuit embodying the invention.

FIG. 1 shows a fluorescent discharge lamp 10 of the hot cathode type with two cathodes 12, 14. One side 14*a* of cathode 14 is connected directly to one 16*b* of a pair of mains input terminals 16, and one side 12*a* of cathode 12 is connected to the other mains input terminal 16*a* through an inductor or choke 18 acting as a ballast. The terminals 16 receive a normal a.c. mains supply voltage of typically 240 volts at 50 hertz. Usually a switch (not shown) will be included in the circuit in conventional manner, and a power factor correction capacitor may be connected across the terminals 16. The other side 12*b*, 14*b* of each of the two cathodes 12, 14, that is, the side not connected to the mains supply terminals 16, is connected to a respective terminal 22, 24 of a starter circuit 20, sometimes termed an igniter.

The starter circuit includes a controlled breakdown device in the form of a thyristor and shown as a silicon controlled semiconductor rectifier (SCR) 26 connected between the starter circuit terminals 22, 24. The control or trigger circuit for the thyristor 26 consists of a diode 28, an avalanche (Zener) diode 30, a capacitor 32 and a resistor 34 all connected in series between the terminals 22 and 24, with the junction between the capacitor 32 and resistor 34 being connected to the gate 36 of the thyristor 26.

A further capacitor 38 is optionally included across the terminals 22, 24, to provide radio interference suppression or to increase the negative voltage peak, and may be in series with a resistor, as described in British Pat. No. 1,223,733.

The operation of the circuit of FIG. 1 will be described by reference to waveforms (a), (b), (c) and (d) of FIG. 2. Waveform (a) shows the supply voltage in dashed lines. When the circuit is in the switched-off state the capacitor 32 is discharged. Upon switch-on, during the first positive half-cycle of the supply voltage, a small charge is impressed on the capacitor 32 through diode 28 and the reverse leakage path of Zener diode 30. When the instantaneous value of the positive voltage across the starter circuit and the lamp is approximately equal to the sum of the reverse breakdown voltage $V_{30\text{-}BR}$ of the Zener diode 30 and the voltage $V_{32\text{-}1}$ attained by the capacitor 32, current flows through the control circuit including diode 28, Zener diode 30 and capacitor 32 to the gate 36 of thyristor 26, to trigger the thyristor into conduction. This happens when the voltage across the starter circuit 20 has the value $V_{20\text{-}1}$, see waveform (a). The gate current which causes triggering further charges the capacitor 32 at a rate which depends essentially on the switching speed and gate sensitivity of the thyristor.

Thus it is seen that, neglecting the voltage drops across diode 28 and resistor 34, triggering of the thyristor 26 occurs when the lamp voltage is equal to the sum of the Zener breakdown voltage and the instantaneous voltage stored on capacitor 32. The resistor 34 is included to stabilize firing of the thyristor, and in particular to prevent spurious firing.

When thyristor 26 conducts, the voltage across the starter circuit is reduced to the forward voltage drop across the thyristor. Thus the voltage across Zener diode 30 is insufficient to sustain conduction, so that the gate current falls to zero. However, a unidirectional current flows through the choke 18 and lamp cathodes 12, 14. This provides cathode heating, the magnitude of this heating current being dependent upon the point in the cycle where the thyristor is triggered, that is, the trigger angle $\theta$, and the saturation characteristics of the choke 18. The current waveform is shown at (b) in FIG. 2.

At some point during the next following negative half-cycle of the mains supply voltage, this current reduces to zero, and at that point the thyristor 26 ceases to conduct and the voltage across the starter circuit instantaneously rises to the value of the mains supply voltage. A negative voltage transient then appears across the lamp. A damped oscillation may be superimposed on the voltage waveform at this point, due to the resonance of inductance and stray capacitance within the circuit. This effect is increased by the addition of the capacitor 38. The thyristor 26 supports the reverse voltage across the discharge lamp thereby assisting ionization between the lamp cathodes 12, 14. For the remainder of the negative half-cycle the voltage across the starter circuit and hence the lamp follows the instantaneous value of the mains supply voltage. Diode 28 prevents conduction in the forward direction through Zener diode 30, and thus prevents discharge of capacitor 32, although some charge will be lost by leakage.

In the next cycle of the mains supply the cycle of operation is repeated. Initially thyristor 26 is non-conductive until triggered and thereupon heating current flows through the cathodes 12, 14. When the current reaches zero the thyristor ceases to conduct and a voltage spike is produced.

During the initial part of this second positive half-cycle, the existing charge on capacitor 32 is reinforced by current flow through diode 28 and Zener diode 30. Again, the thyristor 26 will conduct when the instantaneous value of the voltage across the starter circuit (and hence the lamp) is equal to the Zener breakdown voltage plus the voltage across capacitor 32. In this case the voltage $V_{32\text{-}2}$ across capacitor 32 is higher than in the first positive half-cycle, this voltage also being shown at (d) in FIG. 2. Thus the inclusion of capacitor 32 causes triggering at a point which is slightly later in the cycle, at a slightly higher instantaneous mains voltage. The charge on capacitor 32 is again increased by the gate current pulse.

Provided that there has been no previous discharge through the lamp to modify the sinusoidal form of the positive voltage applied across the starter circuit prior to triggering, the peak current through the starter circuit 20 and cathodes 12, 14 will be somewhat less than that attained during the thyristor conduction period which occurred during the previous cycle. This is illustrated in waveform (b) in FIG. 2.

During subsequent cycles of the mains voltage the sequence is again repeated. The trigger voltage progressively increases, see waveform (a), in line with the increasing charge on capacitor 32, waveform (d), and this increase may be accompanied by a reduction in peak cathode heating current, waveform (b).

Figure 2:
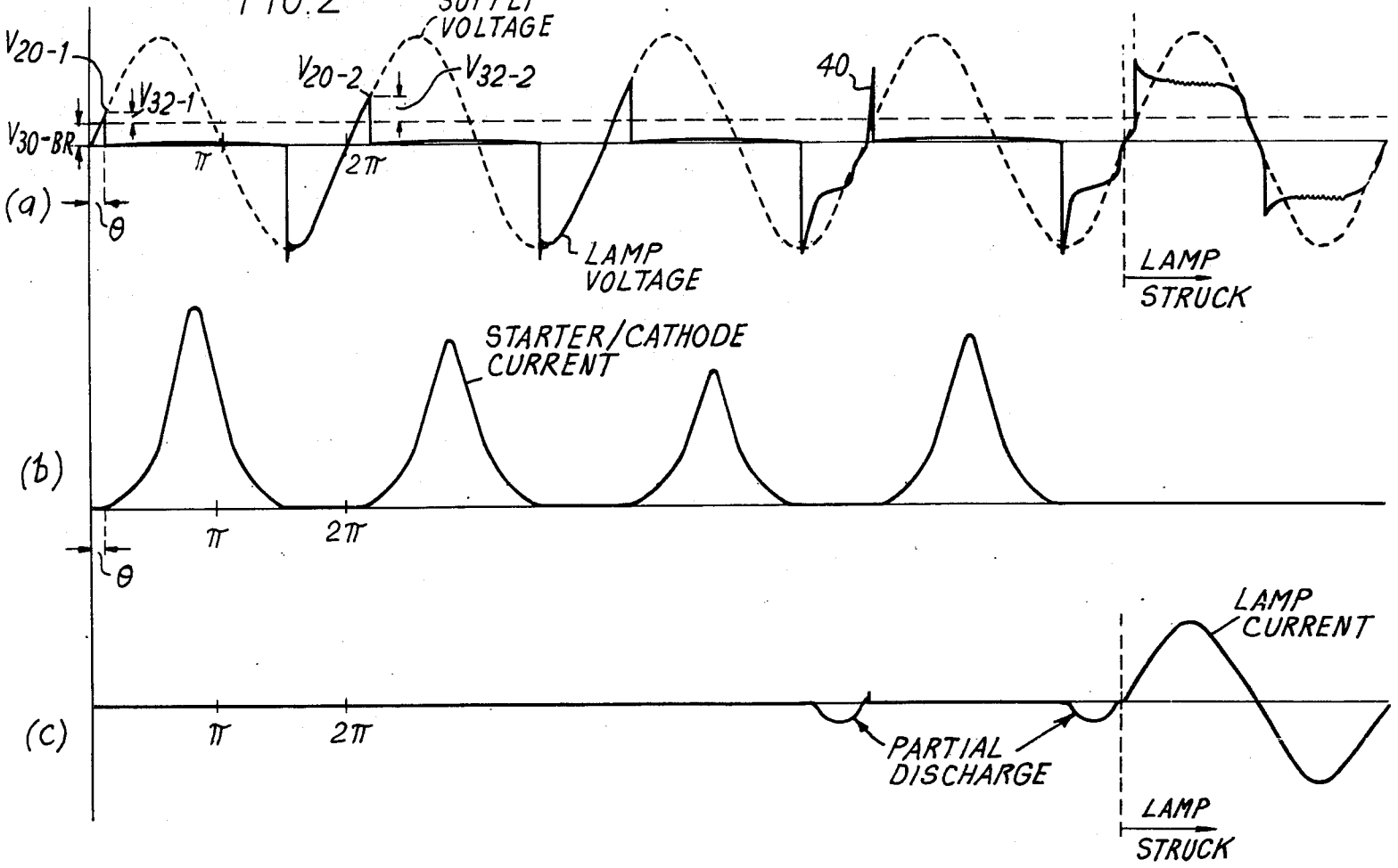
FIG. 2 shows a number of waveforms illustrating the operation of the illustrated embodiments, waveforms (a), (b) and (c) (on one sheet) showing respectively the lamp voltage, starter current and lamp current, and waveforms (d), (e) and (f) (on another sheet) each showing the voltage across a capacitor in the starter circuit for the embodiments of FIGS. 1, 3 and 4 respectively.
Figure 2:
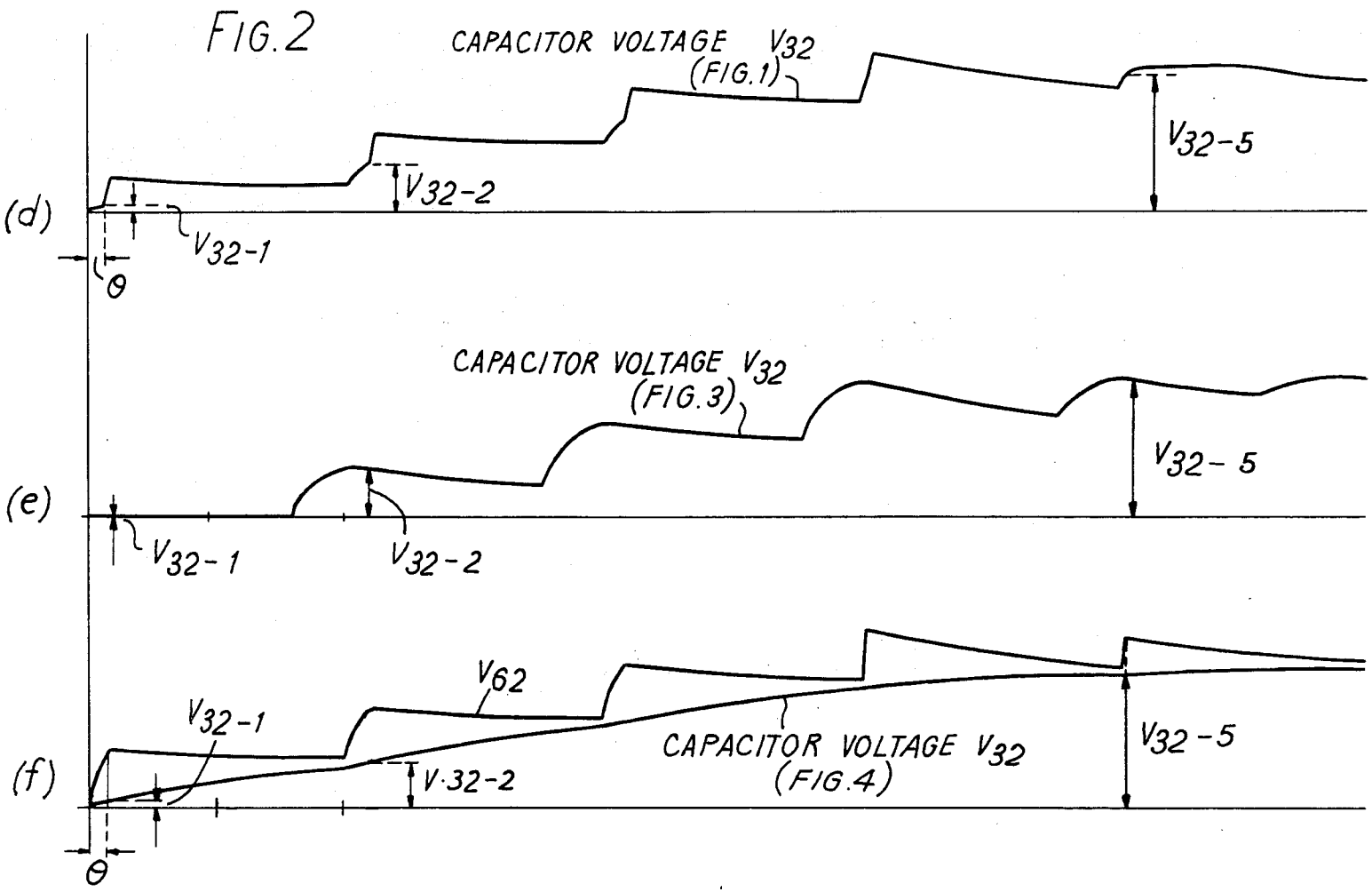

It is assumed in FIG. 2 that during the third cycle of the mains voltage a partial discharge takes place through the lamp, as shown in waveform (c). This may cause a positive spike 40 at the beginning of the next following positive half-cycle, due to the lamp voltage tending to conform to the running mode waveform of the discharge lamp. Thus, although the trigger voltage may have increased, a reduction in the trigger angle can result. Consequently, since the peak cathode current is related to the trigger angle, a reduction in the peak current may not be observed at this point in the starting cycle, and, as shown at (b) in FIG. 2, an increase in cathode heating current occurs in the fourth cycle as compared with the third.

The progressive of the trigger voltage in line with the increasing voltage on capacitor 32, waveform (d), continues until the lamp strikes, and in FIG. 2 this is assumed to happen at the beginning of the fifth cycle, following the negative voltage spike in the second half of the fourth cycle.

Whether the lamp strikes or not the trigger voltage will go on increasing until it reaches a maximum value, determined by leakage resistances, which is too high for the thyristor to be triggered at all by the voltage across the lamp, as triggering would require a voltage across the starter which was greater than the voltage on capacitor 32 by at least the breakdown voltage of Zener diode 30. If the lamp strikes triggering ceases, as the lamp voltage falls upon striking, but even if the lamp does not strike a point is soon reached where the voltage across capacitor 32 is too high for triggering to take place. In either event no current flows through the thyristor, and hence no strain is placed upon the choke 18. The charge on capacitor 32 is maintained through the reverse leakage path of Zener diode 30 by the voltage applied to the starter circuit.

The trigger voltage is thus capable of progressing from an initial low value, of typically about half the r.m.s. supply voltage set by Zener diode 30, up to a maximum value. This maximum value will usually be greater than the supply voltage to ensure that the starting circuit switches off. It would, however, be possible to add a Zener diode in parallel with the capacitor 32 to set the maximum trigger voltage to a desired value, though care must be taken to ensure that any resultant current through the choke, lamp cathodes and thyristor is not excessive under failed lamp conditions. The maximum trigger voltage should also be sufficiently high to prevent re-triggering of the igniter by the lamp waveform when the lamp is running normally.

In the circuit of FIG. 1 the charging rate of capacitor 32 through the reverse leakage path of Zener diode 30 and gate of thyristor 26 is ill-defined due to the variation of the relevent parameters with temperature and as between individual components. In practice, the charging rate of capacitor 32 may be defined satisfactorily by a fixed value resistor (not shown) connected in parallel with the Zener diode 30, provided that low-leakage diodes and a high gate-sensitivity thyristor are employed.

Figure 3:
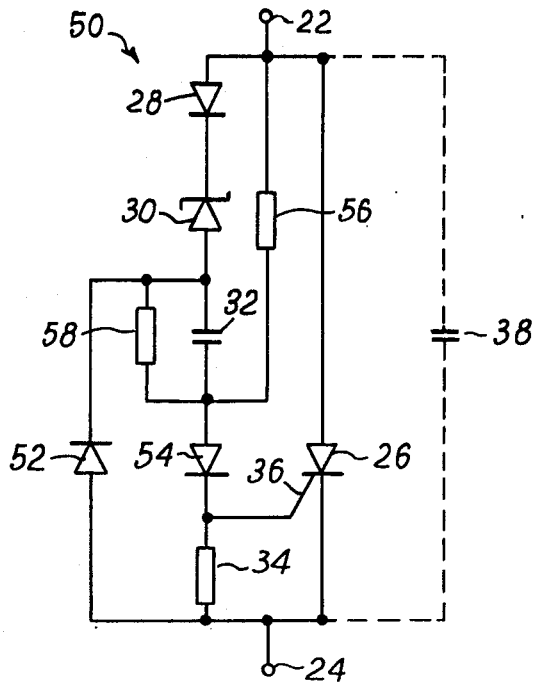
FIG. 3 is a circuit diagram of a first improved starter circuit in which the capacitor charges only during the negative half cycles.

FIG. 3 shows an improved version 50 of the starter circuit 20 of FIG. 1. Similar components are denoted by the same references where appropriate. The circuit 50 includes certain additional components, namely a diode 52 connected between the terminal 24 and the junction between Zener diode 30 and capacitor 32, a diode 54 connected between the capacitor 32 and the junction of thyristor gate 36 and resistor 34, a resistor 56 connected between the terminal 22 and the junction between capacitor 32 and diode 54, and a resistor 58 connected across the capacitor 32.

The operation of the starter circuit of FIG. 3 will be described by reference to waveforms (a), (b), (c) and (e) of FIG. 2. At the start of the first positive half-cycle of the supply voltage capacitor 32 is in a discharged condition and no current flows in the choke and discharge lamp cathodes. As the voltage across the starter circuit 50 increases, the thyristor 26 will be triggered into conduction when the voltage $V_{20}$ across the starter circuit is equal to the breakdown voltage of the Zener diode 30, ignoring the voltage drop across the diodes 28 and 54 and resistor 34. Cathode heating current then flows, until at some point on the negative half-cycle of the supply voltage the cathode heating current falls to zero and the thyristor 26 switches off. The voltage across the starter circuit then rises to a value corresponding to the instantaneous negative value of the mains supply voltage at this point.

As thus-far described the operation of the circuit of FIG. 3 is identical to that of FIG. 1. Now, however, the capacitor 32 can be charged from the supply, current flowing from terminal 24 through diode 52, capacitor 32 and resistor 56 to terminal 22. The rate of charge depends essentially upon the time constant defined by the capacitance of capacitor 32 and the resistance of resistor 56. Charging of capacitor 32 continues until the instantaneous value of the voltage of the supply on the negative half cycle falls below the voltage attained by capacitor 32.

Diode 54 is included to prevent by-pass of the charging current through resistor 34, and diode 28 prevents conduction in the forward direction through Zener diode 30 during the negative half-cycle.

On the second positive half-cycle, triggering of the thyristor 26 occurs when the instantaneous voltage across the starter circuit is equal essentially to the sum of the breakdown voltage (V30-BR) of the Zener diode 30 and the voltage (V30-2) across capacitor 32 due to charging in the previous negative half-cycle.

It will be seen from waveform (e) in FIG. 2 that the capacitor voltage $V_{32}$ progressively increases from one positive half-cycle to the next, due to charging during the intervening negative half-cycles, and as with the circuit of FIG. 1 this will eventually cause the thyristor to stop firing, whether or not the lamp strikes.

The relatively high value resistor 58 is included to permit the capacitor 32 to discharge when the supply voltage is removed (as by switching the lamp off) to reset the starter circuit to its initial conditions. There is of course some slight discharge during the positive half-cycles, as evidenced by the slope of the relevant parts of waveform (e), but this is insufficient to affect adversely the circuit operation.

One example of a circuit as shown in FIG. 3 for operation on 240 volts a.c. at 50 hertz with a 4 ft. 40 watt fluorescent hot cathode tubular discharge lamp complying with British Standard BS 1853 and IEC 81 had the following components:

| | | |
|---|---|---|
| Resistors | 34 | 1 kΩ |
| | 56 | 1 MΩ |
| | 58 | 33 MΩ |
| Capacitors | 32 | 0.1 μF |
| | 38 | 0.0068 μF |
| Diode | 30 | avalanche voltage 110 volts |
| Diodes | 28, 52, 54 | IN4006G |
| Thyristor | 26 | TIP106M |

The choke 18 can be of the same type as is presently used with glow-switch starters, such as that sold under the type No. G69321.4 by Thorn Lighting Limited. However, it may be possible to use in inductor of less iron and copper content as the inductor current in the failed-lamp condition can be guaranteed to be virtually zero.

This circuit provided a peak starting voltage of about 600 volts and an initial pre-start heating current of about 4 amps peak. In the event of failure of the lamp to strike, thyristor triggering ceased after about 2 seconds.

The circuit of FIG. 3 thus improves the operation by controlling more accurately the charging of capacitor 32. This charging occurs during the negative half-cycles of the supply voltage. The alternative embodiment shown in FIG. 4 provides for charging of the capacitor during the positive half-cycles also, thus enabling capacitor 32 to charge more steadily.

Figure 4:
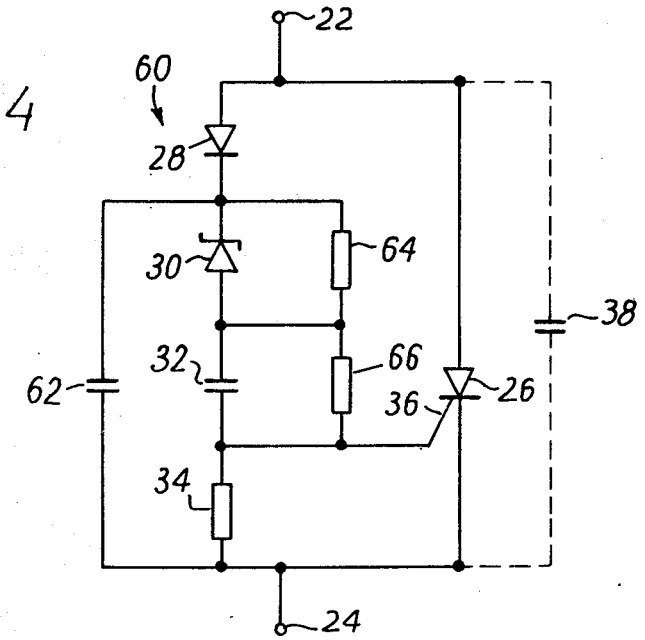
FIG. 4 is a circuit diagram of a second improved starter circuit in which the capacitor also charges during the positive half cycles.

Those components in the starter circuit 60 of FIG. 4 which are similar to corresponding components in FIG. 1 are given the same references and will not be described again. The circuit of FIG. 4, however, also includes a capacitor 62 which is connected between the terminal 24 and the junction between diodes 28 and 30, a resistor 64 connected across the Zener diode 30, and a resistor 66 connected across the capacitor 32.

The operation of the starter circuit 60 of FIG. 4 is illustrated in waveforms (a), (b), (c) and (f) of FIG. 2. The lamp voltage, starter current and lamp current for the embodiments of FIGS. 1, 3 and 4 are sufficiently similar for the same waveforms (a), (b) and (c) in FIG. 2 to be used in describing all the three embodiments.

In the circuit of FIG. 4, initially capacitors 32 and 62 are discharged and no current flows through the lamp cathodes. As the instantaneous value of the mains supply voltage increases during the first positive half-cycle, capacitor 62 is charged through diode 28 to a voltage approaching the instantaneous value of the voltage across the starter circuit. Capacitor 32 is charged from the supply through diode 28 and resistors 64 and 34 at a rate which depends essentially upon the time constant defined by the capacitance of capacitor 32 and the resistance of resistor 64, as the value of resistor 64 is very much greater than that of resistor 34.

When the instantaneous voltage across the starter circuit becomes approximately equal to the sum of the breakdown voltage of Zener diode 30 and the voltage attained by capacitor 32, thyristor 26 is triggered into conduction. Then the forward voltage across the starting circuit is reduced to the forward voltage drop across thyristor 26. Thus the voltage across the Zener diode 30 is reduced to a value which will not sustain the reverse breakdown conditions of the device and the thyristor gate current falls to zero. The short duration gate current pulse will not significantly alter the state of charge of the timing capacitor 32, provided that a thyristor with adequate gate sensitivity is utilized. Capacitor 62, however, has been charged to a peak voltage approaching the forward voltage supported by the thyristor 26 just prior to triggering, and thus continues to charge capacitor 32 through resistors 64 and 34 for the whole of the remainder of the first cycle of the supply voltage, as shown by waveform (f) in FIG. 2. The value of resistor 64 is such that capacitor 32 is only partially charged during the period of one cycle of the supply voltage. Discharge of the capacitors 32 and 62 through the anodecathode path of thyristor 26 when in its conductive state is prevented by diode 28.

The cathode heating current applied to the lamp is again as shown in waveform (b) and the lamp voltage as in (a), and in this respect the operation is precisely similar to that of the circuits of FIGS. 1 and 3.

On the second positive half-cycle, as soon as the value of the instantaneous voltage across the starter circuit exceeds the voltage remaining on the reservoir capacitor 62, charging of capacitor 62 through diode 28 is resumed. Capacitor 62 continues to charge capacitor 32 through resistors 64 and 34, and triggering of thyristor 26 occurs when the instantaneous supply voltage equals the sum of the voltage across capacitor 32 and the Zener breakdown voltage (neglecting the voltages across diode 28 and resistor 34). The operation then continues as for the previous embodiments of FIGS. 1 and 3. The progressively increasing voltage across capacitor 32 again ensures that, if the lamp fails to strike, the thyristor triggers later and later during the positive half-cycle and eventually fails to trigger at all. If the lamp does strike, the voltage across the starter circuit falls, and triggering ceases.

When the supply voltage is removed, the capacitor 32 discharges through resistor 66 and capacitor 62 through resistors 64, 66 and 34, thereby resetting the circuit to its initial conditions.

The provision of the reservoir capacitor 62 in the circuit of FIG. 4 has the advantage of providing a more linear rate of charge for capacitor 32 throughout the trigger point progression which occures over many cycles. This ensures that capacitor 32 is adequately charged even when the voltage on the capacitor approaches the peak value of the supply voltage. This helps to prevent re-triggering of the thyristor on supply voltage transients and high peak lamp voltages. In the circuit of FIG. 3, the rate of charge exhibits an exponential rise as the voltage on capacitor 32 approaches the peak value of the supply voltage.

One example of a circuit as shown in FIG. 4 for operation on 240 volts a.c. at 50 hertz with a 4 ft. 40 watt fluorescent discharge lamp had the following components:

| | | |
|---|---|---|
| Resistors | 34 | 1 kΩ |
| | 64 | 3.9 MΩ |
| | 66 | 30 MΩ |
| Capacitors | 32 | 0.1 μF |
| | 38 | 0.0068 μF |
| | 62 | 0.01 μF |

-continued

| | | |
|---|---|---|
| Diode | 30 | avalanche voltage 110 volts |
| Diode | 28 | IN4006G |
| Thyristor | 26 | TIP106M |

The inductor 18 used was again a type G69321.4 choke made by Thorn Lighting Limited.

Figure 5:
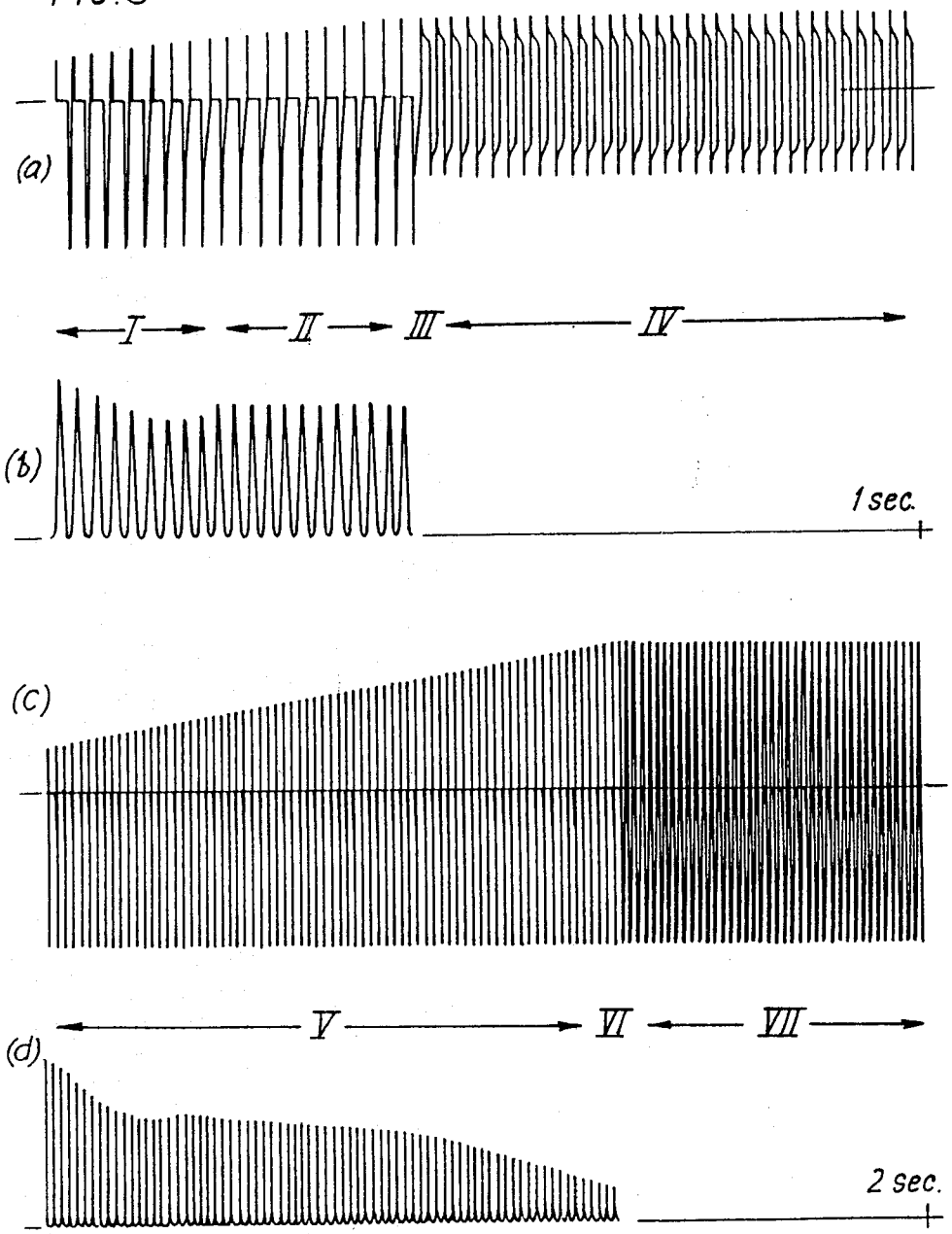
FIG. 5 is a drawing prepared from oscillographs showing characteristics of the starter circuit of FIG. 4, waveforms (a) and (b) showing the lamp voltage and starter current waveforms respectively when the lamp is successfully struck, and waveforms (c) and (d) showing the same parameters when a simulated failed lamp is used.

FIG. 5 shows actual waveforms obtained with the use of the above-described example of the starter circuit of FIG. 4, which did not include the capacitor 38. Waveforms (a) and (b) show respectively the lamp voltage and starter current when the circuit is used successfully to start a lamp, and waveforms (c) and (d) show the lamp voltage and starter current obtained when a failed-lamp condition is simulated by using one cathode from each of two different lamps. The detailed shape of each cycle of the waveforms cannot be seen in FIG. 5 but will be clear by reference to waveforms (a) and (b) of FIG. 2. It should be noted in FIG. 5 that the time scales for waveforms (a) and (b) on the one hand and waveforms (c) and (d) on the other are different; in waveforms (a) and (b) a time period of one second (fifty cycles) is shown while in waveforms (c) and (d) a time period of two seconds (one hundred cycles) is shown.

Waveforms (a) and (b) in FIG. 5 show the various phases illustrated in waveforms (a) and (b) of FIG. 2, that is there is an initial portion I where cathode heating current flows at a gradually decreasing rate followed by several cycles II where partial discharge in the lamp takes place. The slight increase in peak cathode current at the end of phase I is thought to be due to ionization between the individual lamp cathode supports reducing the effective cathode resistance. At point III the lamp strikes, and the waveform during normal lamp running is shown at IV. In this example the lamp strikes in rather less than one half of a second.

Waveforms (c) and (d) show what happens with a simulated failed lamp. Here the lamp voltage remains in the initial phase V as the lamp does not strike, until a point VI is reached where all triggering ceases. Thereafter in region VII the voltage waveform across the lamp is simply the sinusoidal supply waveform. At point VI it is seen that the starter, and hence cathode, current, which has been decreasing fairly steadily, now ceases altogether. Thus no further attempt is made to strike the lamp, and no damage or lamp flickering can occur. In the example shown this cut-off point is reached within 1½ seconds. The slight increase in cathode current which occurs about twenty cycles from switch-on arises due to ionization between the cathode supports. In a real failed lamp there might also be a small amount of electron emission from the heated cathodes, in the form of a pseudo partial discharge.

Figure 6:
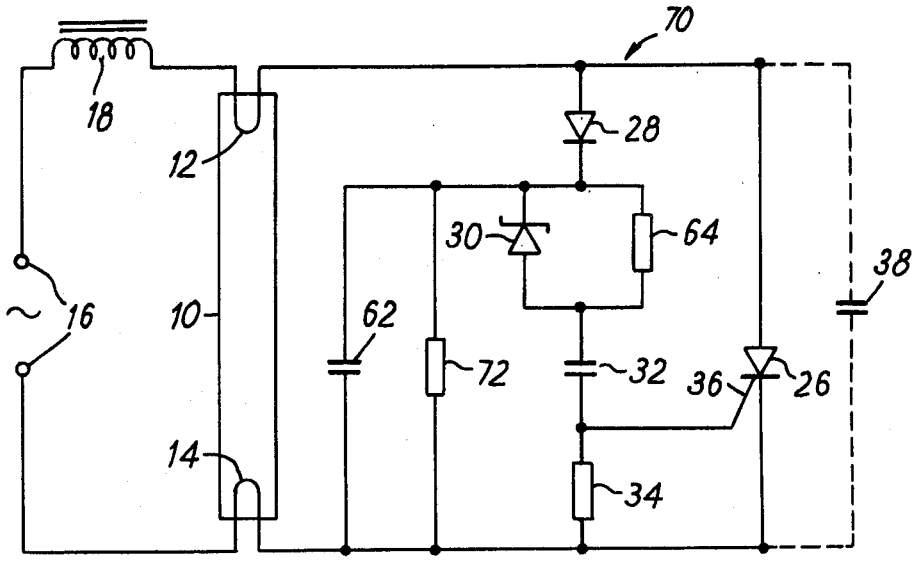
FIG. 6 shows a modification of the starter circuit of FIG. 4.
Figure 7:
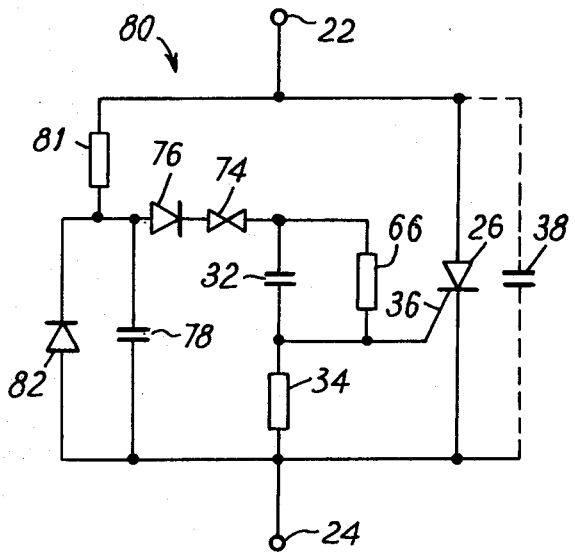
FIG. 7 shows another starter circuit in which the capacitor charges only during the positive half cycles and incorporating a diac instead of a Zener diode.

FIGS. 6 and 7 show two possible alternatives to the starter circuit of FIG. 4. In the starter circuit 70 of FIG. 6, which represents a particularly preferred embodiment of the invention, the discharge resistor 66 for capactior 32 has been removed and replaced by a resistor 72 of about one-third of its value connected directly across the reservoir capactior 62. Upon switch-off capacitor 62 now discharges directly through resistor 72 and capacitor 32 discharges through resistor 72 via the forward conduction path of Zener diode 30 and resistor 34. This re-arrangement provides a reduced reset time upon switch-off, but otherwise the operation of the circuit is identical to that of FIG. 4.

A prototype of the FIG. 6 circuit had the same component values as for FIG. 4, except that the 30 MΩ resistor 66 was deleted, and the resistance of resistor 72 replacing it was 10 MΩ. As an alternative to the capacitor 38, a series circuit consisting of a capacitor and a resistor can be used, typical values then being 0.15 μF and 47 ohms respectively. This will tend to enhance the negative voltage peak across the starter circuit.

The starter circuit 80 of FIG. 7 has a thyristor 26 connected between terminals 22, 24, a radio interference suppression capactior 38, resistors 34 and 66, and timing capacitor 32 as FIG. 4. The Zener diode 30, diode 28, reservoir capacitor 62 and resistor 64 are replaced by a diac 74 connected to the capacitor 32, a diode 76 connected to the other end of the diac, and a capacitor 78 connected across the series circuit comprising the diode 76, diac 74, capacitor 32 and resistor 34. The capacitor 78 charges through a resistor 81 connected to terminal 22. A diode clamp 82 is provided to stop capacitor 78 from charging up negatively during the negative half cycle of the supply voltage, and thus ensure that it is discharged at the end of each negative half-cycle.

Triggering occurs at a progressively increasing time from the start of the positive half-cycle of the supply voltage. During each positive half-cycle of the supply the capacitor 78 charges through resistor 81 until the charge on capacitor 78 is sufficient to trigger the diac 74, thus firing the thyristor 26 and impressing a charge on the capacitor 32. During each negative half-cycle the capacitor 78 is discharged. The timing of the trigger pulse depends on the time constant defined by the capacitance of capacitor 78 and the resistance of resistor 81, and progression of the trigger point is achieved by charging capacitor 32 such that capacitor 78 is required to charge to a higher voltage on successive positive half-cycles in order to trigger the diac 74. The waveform representing the voltage across the lamp is similar to waveform (a) of FIG. 2.

The circuits of FIGS. 1, 4, 6 and 7 increase the trigger voltage progressively with the cycles of the supply voltage at a rate which is broadly constant, regardless of supply voltage. Since the starter circuit switches off when the trigger voltage exceeds the supply voltage, this means that the time to switch-off, i.e. the period of time during which the igniter tries to start the lamp, is dependent upon the supply voltage. At low supply voltages the time to switch-off can, in certain circumstances, be reduced quite considerably. If the circuit is adjusted to provide an adequate time to switch-off at such low supply voltages, then at normal supply voltages the time to switch-off could be undesirably long for certain applications.

In the circuit of FIG. 3, the timing capacitor is charged from the negative half-cycles of the voltage across the starter circuit, the peak of which remains constant for a given supply voltage. The trigger voltage progression is therefore essentially exponential, and some measure of stabilization of the switch of time is achieved.

Figure 8:
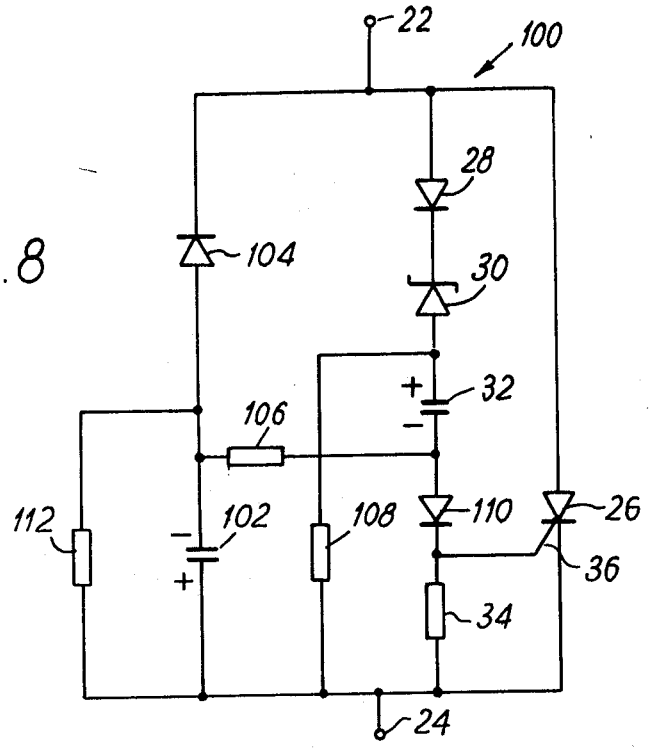
FIG. 8 is a circuit diagram of a starter circuit embodying the invention which provides a substantially constant time to switch off.
Figure 9:
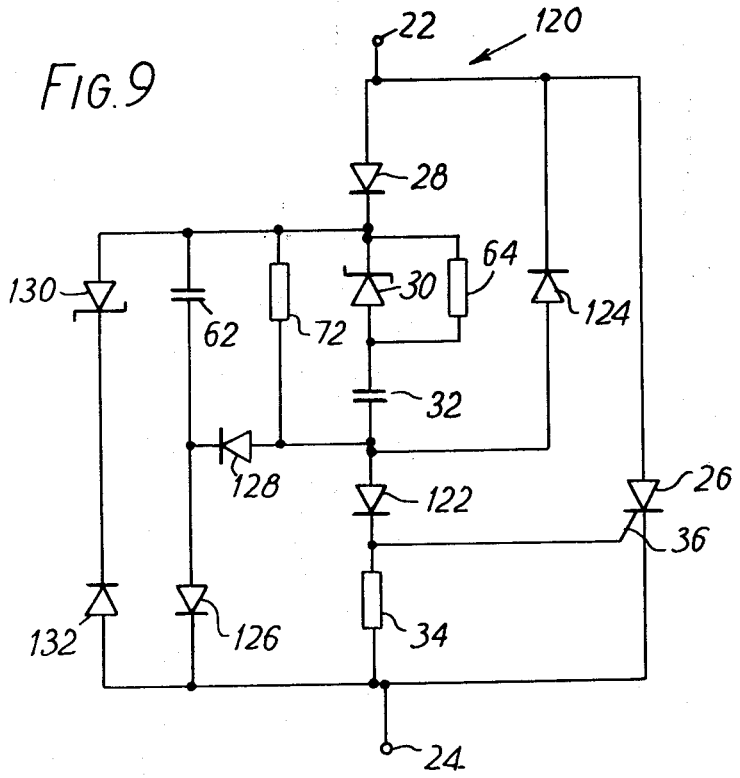
FIGS. 9 and 9A are circuit diagrams of two other starter circuits based on that of FIG. 6 which provide a substantially constant time to switch off.
Figure 9A:
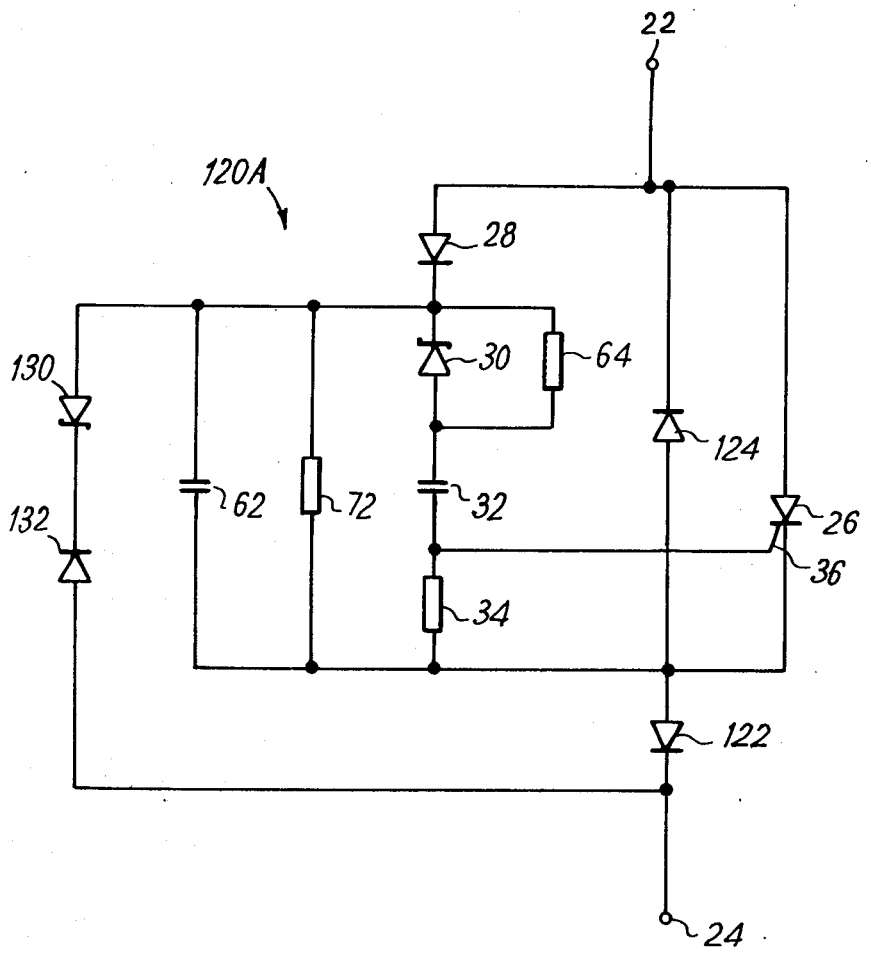

FIGS. 8, 9 and 9A show circuits in which this effect is further ameliorated. In these circuits the switch-off time is essentially independent of the supply voltage. In FIG. 8 this is achieved by charging the capacitor 32 at a rate which is dependent upon the supply voltage, whereas in FIGS. 9 and 9A the charging rate is constant but the capacitor 32 is pre-charged upon switch-on of the supply to a voltage which is a fixed amount below the supply voltage.

Turning first to the starter circuit 100 of FIG. 8, those components which are similar to those of the circuit of FIG. 1 are given the same reference numerals and will not be described again. The circuit includes a reservoir capacitor 102 which can be charged during the negative half-cycles of the supply voltage through a diode 104 to the peak negative supply voltage. Capacitor 102 can then charge capacitor 32 during both half-cycles by way of two resistors 106 and 108, connected as shown. A diode 110 ensures the charging of capacitor 32 to the correct polarity, i.e. the junction with resistor 108 is positive with respect to the junction with resistor 106, and resistor 112 permits capacitors 32 and 102 to discharge upon switch-off of the supply.

Positive and negative signs are given on FIG. 8 to indicate the senses of charging of capacitors 32 and 102; they do not imply that these are electrolytic capacitors.

The trigger voltage now exhibits an exponential rise due to charging of capacitor 32 from capacitor 102 through resistors 106 and 108. At low supply voltages, capacitor 102 is charged to a correspondingly lower value and the rate of trigger voltage exponential rise is consequently reduced. Thus the time taken for the trigger voltage to exceed the positive voltage across the igniter is essentially the same for both high and low supply voltages, thereby stabilizing the time to switch-off of the starter circuit.

The starter circuit 120 of FIG. 9 is based on that of FIG. 6 but includes some additional diodes. These are: diode 122 connected between capacitor 32 and resistor 34, diode 124 connected between the terminal 22 and the junction of capacitor 32 and diode 122, diode 126 connected in series with capacitor 62, diode 128 connecting resistor 72 to the junction of capacitor 62 and diode 126, and a Zener diode 130 and diode 132 connected across the capacitor 62 and diode 126.

Upon switch-on of the supply voltage a current flows through diode 124, capacitor 32, Zener diode 30, Zener diode 130 and diode 132. The capacitor 32 will thus be charged to a value equal to the supply voltage *less* the voltage drop across these four diodes, which for practical purposes means the drop across Zener diodes 30 and 130. Thus the capacitor 32 is pre-charged to a fixed amount below the peak of the supply voltage regardless of the actual value of the supply voltage. This ensures that the trigger voltages traverse a fixed voltage range, which results in a constant time to switch-off of the starter circuit regardless of supply voltage variations.

The circuit 120A of FIG. 9A is a modification of that of FIG. 9 and is simpler and more reliable. The alterations made will be apparent from the figure, and involve the repositioning of diode 122, the removal of diode 126, and replacement of diode 128 by a direct connection. The operation of the circuit is similar to that of FIG. 9, the capacitor 32 being pre-charged to a fixed voltage below the peak of the supply voltage through diode 132, Zener diode 130, Zener diode 30, resistor 34 and diode 124. Thus, switch-off time stabilization is achieved in a similar manner to that of the circuit of FIG. 9.

It should be noted that with this circuit the charging of capacitor 32 via diode 132 and Zener diode 130 can only occur during the first negative half-cycle after connection of the supply, which may not be coincident with switch-on of the supply voltage.

Figure 10:
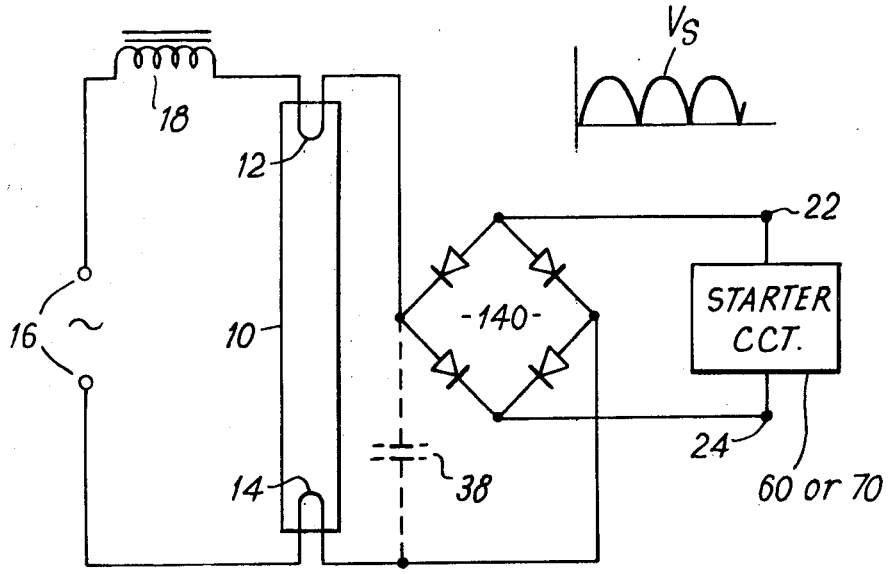
FIG. 10 is a circuit diagram illustrating the use of a rectifier with the starter circuit of FIG. 4 or FIG. 6.

FIG. 10 illustrates how a full-wave bridge rectifier circuit 140 may be connected between the lamp 10 and the starter circuit. This is appropriate for the starter circuits 60 or 70 of FIGS. 4 and 6 respectively, although the circuit 70 of FIG. 6 is preferred. The open circuit voltage applied across the starter circuit is thus as shown as $V_s$ on FIG. 10. If capacitor 38 is used this should be connected before the bridge rectifier. With full-wave rectification the starter circuit triggers every half-cycle of the supply voltage, providing a progressively increasing voltage on both positive and negative half-cycles of the supply voltage until triggering is cut off as described above. The cathode heating current is somewhat reduced because of the absence of saturation effects in the choke.

The starter circuits such as that of FIG. 6 will also work in principle if the lamp itself is operated on a rectified a.c. supply.

Figure 11:
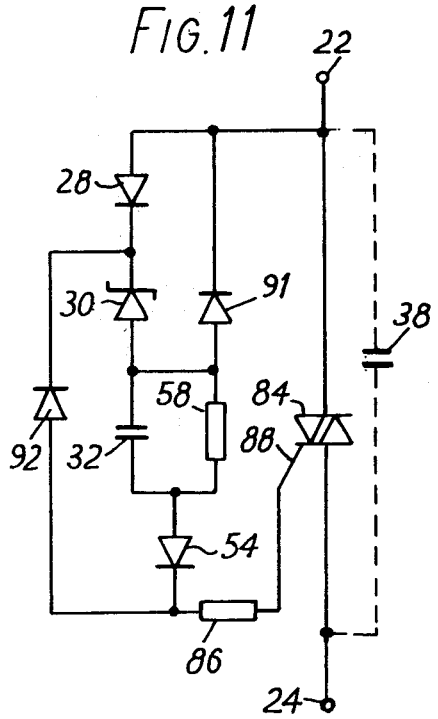
FIG. 11 shows a starter circuit in which the main semiconductor switch is a triac to permit bi-directional cathode heating current.

FIG. 11 shows an embodiment of the invention which is based broadly on the circuit of FIG. 1, but in which the thyristor 26 has been replaced by a triac 84 to permit bi-directional cathode heating current. A diode 28, Zener diode 30, capacitor 32 and diode 54 are connected in series, and a resistor 86 couples the diode 54 to the gate 88 of triac 84. A discharge resistor 58 is connected across capacitor 32. A diode 91 connects the junction of Zener diode 30 and capacitor 32 to the terminal 22, and a diode 92 connects the junction of Zener diode 30 and diode 28 to the resistor 86.

During each negative half-cycle the triac 84 is triggered via diode 91, the reverse conduction path of Zener diode 30, diode 92 and resistor 86. The trigger point is determined essentially by the avalanche breakdown voltage of Zener diode 30, and thus does not vary. On successive positive half-cycles, however, the trigger voltage is applied to the gate 88 of the triac 84 through diode 28, Zener diode 30, capacitor 32, diode 54 and resistor 86, and thus the trigger voltage progressively increases over a number of cycles as described with reference to FIG. 1.

Thus, after a predetermined period of bi-directional cathode heating current, triggering on the positive half-cycle ceases. Triggering continues on the negative half-cycles, however, and thus it is necessary for the breakdown voltage of the Zener diode 30 to be such that the current through the choke, lamp cathodes and starter circuit is limited to an acceptable level. Nevertheless the circuit does provide the advantage that the cathode and choke current in the failed lamp condition will be substantially less than the initial cathode heating current. Furthermore, as the heating current flows on both positive and negative half-cycles there is less risk of the choke simply remaining saturated.

It will be appreciated that the various features of the separate embodiments described may be used in combinations other than those illustrated.

In addition many other circuits may be used in accordance with the invention. For example, the control circuit for triggering SCR 26 may include instead of the capacitor 32 (in FIG. 1 for example) a thermistor, or thermally-responsive resistor arranged so that as it heats up a progressively higher voltage is required to trigger the lamp. The heat source for the thermistor can be the SCR 26 itself.

It will be seen from the above that the circuits described and illustrated avoid the disadvantages of the known glow switch and semi-resonant starters, and provide in particular with the embodiments of FIGS. 1 to 9A higher initial pre-start cathode heating currents, a suppressed initial positive lamp voltage which minimises the likelihood of cold starting effects, and low or even zero cathode current in the failed-lamp condition which means that constraints on the ballast design are much reduced.

We claim:

1. In a discharge lamp circuit comprising a discharge lamp having a pair of cathodes, a reactive ballast, and a cyclically-varying voltage supply for said lamp and ballast, a starter circuit, wherein said starter circuit comprises:

two starter input terminals for connection to said lamp cathodes;

a controlled switch connected across said starter input terminals and having a control input; and a control circuit connected to said control input and adapted to render said switch conductive at a desired point during the cycle of the applied voltage, said control circuit including a capacitor the charge upon which progressively varies with successive cycles of the applied voltage in such a manner as to cause a variation in the trigger points at which conduction occurs, whereby the instantaneous applied voltage which is required for conduction to occur increases with successive cycles of the applied voltage after switch-on of the circuit.

2. A starter circuit according to claim 1, wherein the controlled switch comprises a controlled breakdown device.

3. A starter circuit according to claim 1, wherein the controlled switch comprises a thyristor.

4. A starter circuit according to claim 1, wherein the controlled switch comprises a silicon controlled semiconductor rectifier.

5. A starter circuit according to claim 1, wherein the controlled switch comprises a triac.

6. A starter circuit according to claim 1, wherein said control circuit comprises a series circuit comprising a diode, an avalanche diode, and said capacitor, the series circuit being connected between one of the starter input terminals and the control input of said switch.

7. A starter circuit according to claim 6, including a resistor connected across said avalanche diode.

8. A starter circuit according to claim 6, wherein said diode is connected to said one of the starter input terminals, said avalanche diode is connected to said diode, and said capacitor is connected to said avalanche diode.

9. A starter circuit according to claim 8, including a resistor coupled between said capacitor and the other of said starter input terminals, the junction of said capacitor and said resistor being connected to the control input of said switch.

10. A starter circuit according to claim 9, including a further diode connected between said capacitor on the one hand, and said resistor and the control input of said switch on the other.

11. A starter circuit according to claim 8, including a capacitor connected between said other starter input terminal and the junction of said avalanche diode and said diode.

12. A starter circuit according to claim 1, wherein said control circuit includes means for charging said capacitor from the supply during half-cycles of the supply when said switch is non-conductive.

13. A starter circuit according to claim 1, wherein said control circuit includes means for charging said capacitor during half-cycles of the supply when said switch is conductive.

14. A starter circuit according to claim 1, including a discharge resistor connected across said capacitor.

15. A starter circuit according to claim 13, wherein said means for charging said capacitor comprises a second capacitor which is charged through a diode to substantially the voltage across said starter input terminals.

16. A starter circuit according to claim 15, including a discharge resistor connected across said second capacitor.

17. A starter circuit according to claim 1, wherein said control circuit includes means for charging said capacitor at a rate which is dependent upon the voltage of said supply.

18. A starter circuit according to claim 1, wherein said control circuit includes means for pre-charging said capacitor to a voltage which is a predetermined amount below the voltage of said supply.

19. A starter circuit according to claim 1, including a suppression capacitor connected across said starter input terminals.

20. A starter circuit according to claim 1, wherein said starter input terminals are connected to the output of a rectifier.

21. A starter circuit according to claim 1, wherein said switch conducts on both half-cycles of the supply voltage, but the increase in the required applied voltage occurs only during alternate half-cycles.

* * * * *